US009429118B2

(12) United States Patent
Oohashi

(10) Patent No.: US 9,429,118 B2
(45) Date of Patent: Aug. 30, 2016

(54) FUEL PUMP MODULE

(71) Applicant: DENSO CORPORATION, Kariya, Aichi-pref. (JP)

(72) Inventor: Masaharu Oohashi, Takahama (JP)

(73) Assignee: DENSO CORPORATION, Kariya (JP)

( * ) Notice: Subject to any disclaimer, the term of this patent is extended or adjusted under 35 U.S.C. 154(b) by 136 days.

(21) Appl. No.: 14/469,965

(22) Filed: Aug. 27, 2014

(65) Prior Publication Data

US 2015/0059707 A1 Mar. 5, 2015

(30) Foreign Application Priority Data

Aug. 28, 2013 (JP) ..... 2013-176989

(51) Int. Cl.

| | |
|---|---|
| ***F02M 37/04*** | (2006.01) |
| ***F02M 37/22*** | (2006.01) |
| ***F02M 37/18*** | (2006.01) |
| ***F02M 37/00*** | (2006.01) |
| ***F02M 37/02*** | (2006.01) |
| ***F02M 37/10*** | (2006.01) |

(52) U.S. Cl.

CPC ..... *F02M 37/04* (2013.01); *F02M 37/0047* (2013.01); *F02M 37/0088* (2013.01); *F02M 37/025* (2013.01); *F02M 37/106* (2013.01); *F02M 37/18* (2013.01); *F02M 37/22* (2013.01)

(58) Field of Classification Search

CPC ..... F02M 37/04; F02M 37/0047; F02M 37/0088; F02M 37/10; F02M 37/18

See application file for complete search history.

(56) References Cited

U.S. PATENT DOCUMENTS

| | | | | |
|---|---|---|---|---|
| 4,834,132 | A | 5/1989 | Sasaki et al. | |
| 5,024,583 | A * | 6/1991 | Sasaki | F04F 5/54 417/194 |
| 2002/0112700 | A1 | 8/2002 | Iwamoto et al. | |
| 2005/0241617 | A1* | 11/2005 | Kojima | F02D 41/3094 123/446 |
| 2007/0217921 | A1 | 9/2007 | Oohashi et al. | |
| 2008/0184971 | A1* | 8/2008 | Lubinski | F02M 37/0058 123/511 |

FOREIGN PATENT DOCUMENTS

| | | |
|---|---|---|
| JP | 62-96773 | 5/1987 |
| JP | 2006-125248 | 5/2006 |

(Continued)

OTHER PUBLICATIONS

Office Action (3 pages) dated Jan. 5, 2016, issued in corresponding Japanese Application No. 2013-176989 and English translation (4 pages).

(Continued)

*Primary Examiner* — Lindsay Low
*Assistant Examiner* — Kevin Lathers
(74) *Attorney, Agent, or Firm* — Nixon & Vanderhye, PC

(57) ABSTRACT

A fuel pump module for a fuel tank having a plurality of fuel tank rooms includes a jet pump with a jet part, a suction part, and a swirling flow formation member that has relatively-small openings that are symmetrically disposed on a center axis of the jet part on one side of the member close to the suction part. The fuel passing through the openings are induced into a swirling flow that is injected into the suction part for transporting the fuel from one tank to an other tank. As a result, fuel may be efficiently transported from the one tank to the other tank without having a fuel pump in the one tank.

4 Claims, 9 Drawing Sheets

(56) References Cited

FOREIGN PATENT DOCUMENTS

| | | |
|---|---|---|
| JP | 2009-243330 | 10/2009 |
| JP | 2011-012615 | 1/2011 |

OTHER PUBLICATIONS

U.S. Appl. No. 14/470,198, filed Aug. 27, 2014 in the name of Masaharu Oohashi.
U.S. Appl. No. 14/470,004, filed Aug. 27, 2014 in the name of Masaharu Oohashi.
U.S. Appl. No. 14/470,090, filed Aug. 27, 2014 in the name of Masaharu Oohashi.
U.S. Appl. No. 14/469,930, filed Aug. 27, 2014 in the name of Masaharu Oohashi.
U.S. Appl. No. 14/470,198, filed Aug. 27, 2014, Fuel Pump Module.
U.S. Appl. No. 14/470,004, filed Aug. 27, 2014, Fuel Pump Module and Method of Manufacturing the Same.
U.S. Appl. No. 14/470,090, filed Aug. 27, 2014, Fuel Pump Module.
U.S. Appl. No. 14/469,930, filed Aug. 27, 2014, Fuel Pump Module.
Office Action (3 pages) dated Jul. 9, 2015, issued in corresponding Japanese Application No. 2013-176989 and English translation (4 pages).

* cited by examiner

FUEL PUMP MODULE

CROSS REFERENCE TO RELATED APPLICATION

The present application is based on and claims the benefit of priority of Japanese Patent Application No. 2013-176989, filed on Aug. 28, 2013, the disclosure of which is incorporated herein by reference.

TECHNICAL FIELD

The present disclosure generally relates to a fuel pump module.

BACKGROUND INFORMATION

Conventionally, a fuel pump module is disposed in a fuel tank with a plurality of fuel tank rooms and a fuel transport unit transports fuel to one tank room from the other. For example, a patent document 1 (i.e., Japanese Patent No.: JP-A-2007-247581) discloses a fuel pump module that includes a fuel pump, a subtank that houses the fuel pump while being housed in a fuel tank, and a jet pump that transports the fuel from the fuel tank to the subtank.

The fuel pump module disclosed in the patent document 1 has fuel tank having a first tank room housed inside a second fuel room, thereby making a fuel transport distance of the jet pump relatively short. However, if the first tank room is distant from the second tank room due to vehicle layout and/or the configuration of the fuel pump module, for example, the fuel transport distance of the jet pump may become relatively long. In such case, the fuel may evaporate due to the temperature rise in a communication passage between the first tank room and the second tank room, thereby making it difficult for the jet pump of the fuel pump module in the patent document 1 to transport the fuel from the first tank room and the second tank room. Further, such a configuration may make it difficult for the fuel pump module to discharge the fuel from the fuel tank toward an outside of the fuel tank.

SUMMARY

It is an object of the present disclosure is to provide a fuel pump module which is capable of discharging a fuel from the fuel tank to an internal-combustion engine when the fuel tank has multiple fuel tank rooms.

In an aspect of the present disclosure, the fuel pump supplies fuel to an internal-combustion engine from a fuel tank having a plurality of fuel tank rooms and discharges the fuel from the fuel tank to a combustion chamber of the internal-combustion engine. The fuel pump module includes a first pump discharging the fuel from the fuel tank to the combustion chamber of the internal-combustion engine, a first filter removing foreign substance from the fuel that is discharged from the first pump, and a first supply port disposed at a position between the first filter and the combustion chamber into which the fuel is discharged from the first pump, the first supply port allowing the fuel filtered by the first filter to flow therethrough. The fuel pump module also includes a second pump discharging the fuel from the fuel tank to an air-intake system of the internal-combustion engine, and a second supply port disposed at a position between the second filter and the air-intake system, the second supply port allowing the fuel filtered by the second filter to flow therethrough. Further, the fuel pump module includes a fuel transport unit transporting the fuel to a first fuel tank room that houses the first pump and the second pump from a second fuel tank room, and a communication passage providing fluid communication between the first fuel tank room and the second fuel tank room through which the fuel transported by the fuel transport unit flows. The fuel transport unit causes a swirling flow of the fuel when the first pump or from the second pump discharges the fuel.

The fuel pump module of the present disclosure is provided with two fuel pumps, two filters, and two supply ports. The fuel tank which houses the above components has plurality of fuel tank rooms, and the two fuel pumps are housed in the one fuel tank room. For a secure discharge of the fuel, the fuel pump module of the present disclosure transports the fuel from one fuel tank room to the other fuel tank room, i.e., from a tank room that houses no fuel pump to a tank room that houses the two fuel pumps. When the fuel is transported in such manner, the fuel transport unit utilizes the pressure of the discharged fuel from the first or second pump to make a swirling flow of the fuel. In such configuration, even when the fuel evaporates due to a temperature rise of the communication passage formation member, the fuel in the communication passage is pressingly transported in one direction which leads to the one fuel tank room, i.e., is transported to the one fuel tank room having the two fuel pumps. Therefore, the fuel in the fuel tank is collected within a proximity of the two fuel pumps that are housed in the one fuel tank room, which makes the fuel to be securely discharged into the internal-combustion engine.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereafter, the embodiment of the present disclosure is described based on the drawings.

One Embodiment

Figure 1:
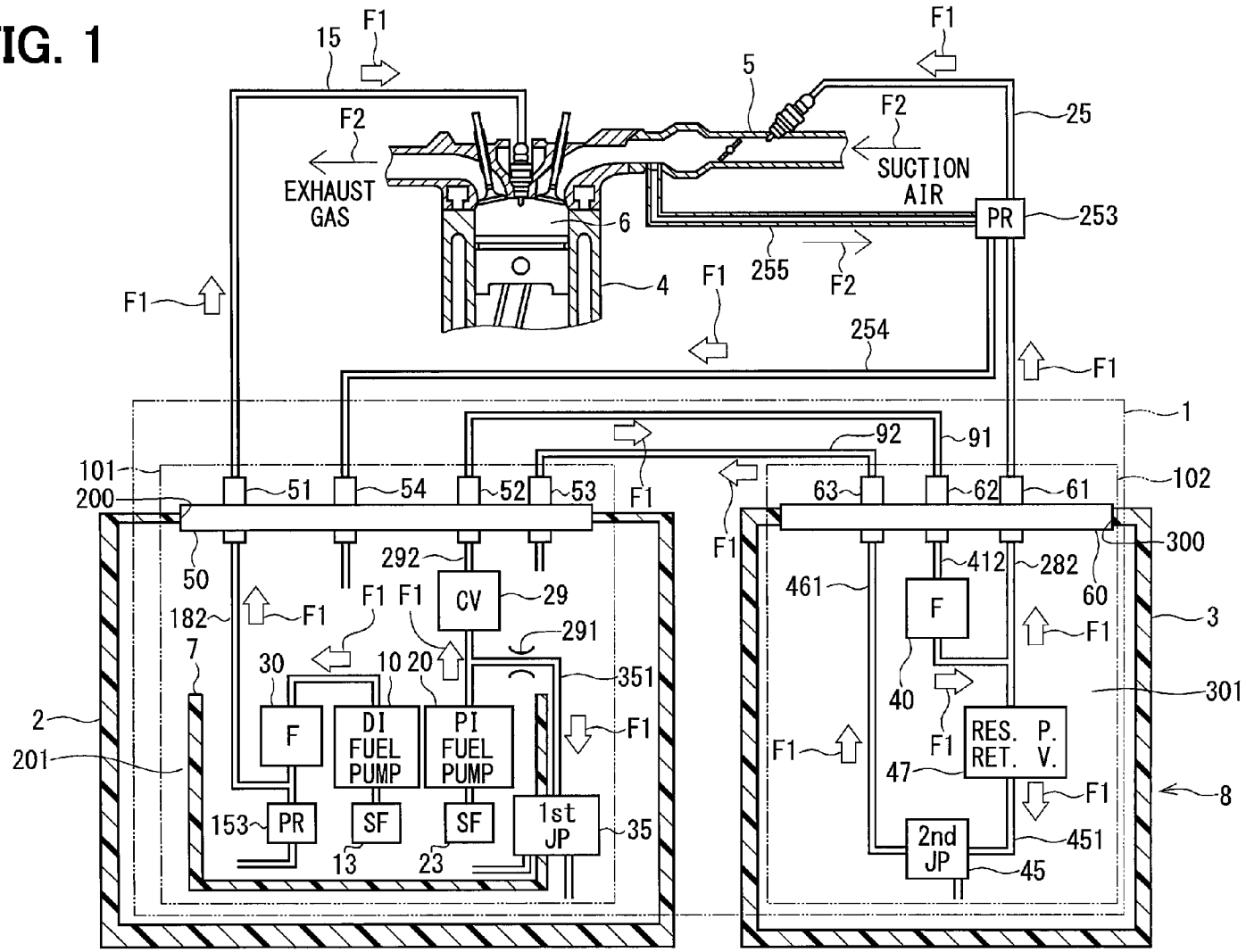
FIG. 1 is a block diagram of a system of a fuel pump module in one embodiment of the present disclosure.

The block diagram explaining a system of a fuel pump module 1 in one embodiment of the present disclosure is shown in FIG. 1. The fuel pump module 1 supplies, to an engine 4, a fuel stored by a fuel tank 8 which has two "fuel tank rooms", i.e., a first tank room 201 and a second tank room 301. The fuel pump module 1 supplies, to either one of a combustion chamber 6 of the engine 4 or an air-intake system 5 which is connected to the engine 4, the fuel in different pressures according to a drive state of the engine 4. The fuel pump module 1 is, as shown in FIG. 1, comprised of a first module 101 and a second module 102 together with other parts such as transport pipes 91 and 92 etc. by which the first module 101 and the second module 102 are connected for flowing the fuel back and forth between a first tank 2 and a second tank 3. Further, a white arrow F1 in FIG. 1 shows a flow of the fuel. Further, a solid line arrow F2 in FIG. 1 shows a flow of a gas. The second tank 3 is equivalent to an "other fuel tank room" in the claims.

The first module 101 is disposed in the first tank 2. The first module 101 pressurizes the fuel in the first tank 2, and supplies the pressurized fuel to the engine 4, or transports it to the second tank 3. The first module 101 comprises a suction filter 13, a direct injection fuel pump 10 (i.e., hereafter designated as a "DI fuel pump 10"), a suction filter 23, a port injection fuel pump 20 (i.e., hereafter designated as a "PI fuel pump 20"), a direct injection filter 30 (i.e., hereafter designated as a "DI filter 30"), a first jet pump 35, a first flange 50, a primary subtank 7, and other parts. The suction filter 13 is equivalent to a "first suction filter" in the claims. The DI fuel pump 10 is equivalent to a "first pump" in the claims. The PI fuel pump 20 is equivalent to a "second pump" in the claims. The DI filter 30 is equivalent to a "first filter" in the claims.

The suction filter 13 comprises a saccate element part 131, a cylindrical connection part 132, etc. The suction filter 13 removes foreign substance from the fuel in the primary subtank 7 by using the element part 131. The connection part 132 is disposed at a position between the saccate element part 131 and the suction part 12 of the DI fuel pump 10, and is connected to the suction part 12. The connection part 132 providing a connection port 133 allows a communication between an inside of the element part 131 and a suction port 121 of the suction part 12 of the DI fuel pump 10.

The DI fuel pump 10 is an electromotive pump disposed in the primary subtank 7 that is housed in the first tank 2. The DI fuel pump 10 pressurizes the fuel in the primary subtank 7 to 500 kPa, for example, and directly supplies the pressurized fuel to the combustion chamber 6 of the engine 4 via a direct injection supply pipe 15 (i.e., hereafter designated as a "DI supply pipe 15") leading to a direct injection supply port 51 (i.e., hereafter designated as a "DI supply port 51") that is disposed on the first flange 50. In the fuel pump module 1 in one embodiment, it is configured that an amount of the fuel supplied from the DI fuel pump 10 to the engine 4 is greater than an amount of the fuel supplied from the PI fuel pump 20 to the engine 4. The DI fuel pump 10 comprises the suction part 12, a pump part 14, a motor part 16, a discharge part 18, and the like. The DI supply port 51 is equivalent to a "first supply port" in the claims.

The suction part 12 is disposed on a filter side (i.e. close to the suction filter 13) of the DI fuel pump 10, and is connected to the pump part 14 of the DI fuel pump 10. The suction part 12 has the suction port 121. The suction port 121 allows communication between an inside of the suction filter 13 and an inside of the pump part 14. The suction port 121 is disposed at an away-from-axis position (i.e., a position that is different from a position of an axis of the DI fuel pump 10), and sends the fuel from the primary subtank 7 via the suction filter 13 to the pump part 14.

The pump part 14 comprises an impeller which is not illustrated, a pump case 141 which forms a pump room in which the impeller is rotatably accommodated, together with other parts. The pump room allows communication between the suction port 121 of the suction part 12 and a discharge port 181 of the discharge part 18.

The motor part 16 is a brushless motor which comprises a stator, a rotor, a shaft, and the like, all of which are not illustrated. When an electric power is supplied to a not-illustrated winding which is wound on a cylindrical stator via a wire harness 161 (see FIG. 2) and a power supply terminal 162, a rotor positioned in an inside of the stator rotates together with the shaft. A rotation torque of the shaft is transmitted to the impeller of the pump part 14. In such manner, the impeller of the pump part 14 rotates, the fuel in the pump room is pressurized, and the pressurized fuel is sent to the discharge part 18.

The discharge part 18 is disposed on an opposite side of the suction part 12 relative to the pump part 14 and the motor part 16. The discharge part 18 has the discharge port 181 which allows communication between an inside of the pump part 14 and an inside of the pump case 11. The fuel pressurized by the pump part 14 is sent to a fuel passage 111 that is formed in an inside of the pump case 11 via the discharge port 181.

The pump case 11 is a cylindrical member having a bottom, which is made of resin. The pump case 11 comprises a bottom part 112, a side part 113, a connection part 119, and the like. The DI fuel pump 10 and the DI filter 30 are housed in an inside of the pump case 11.

The bottom part 112 is formed substantially in a disk shape from resin. A through hole 116 is disposed on the bottom part 112 substantially in parallel with an axis of the DI fuel pump 10. The through hole 116 accepts a connector to be electrically connected to the power supply terminal 162 of the motor part 16 inserted therein.

Figure 4:
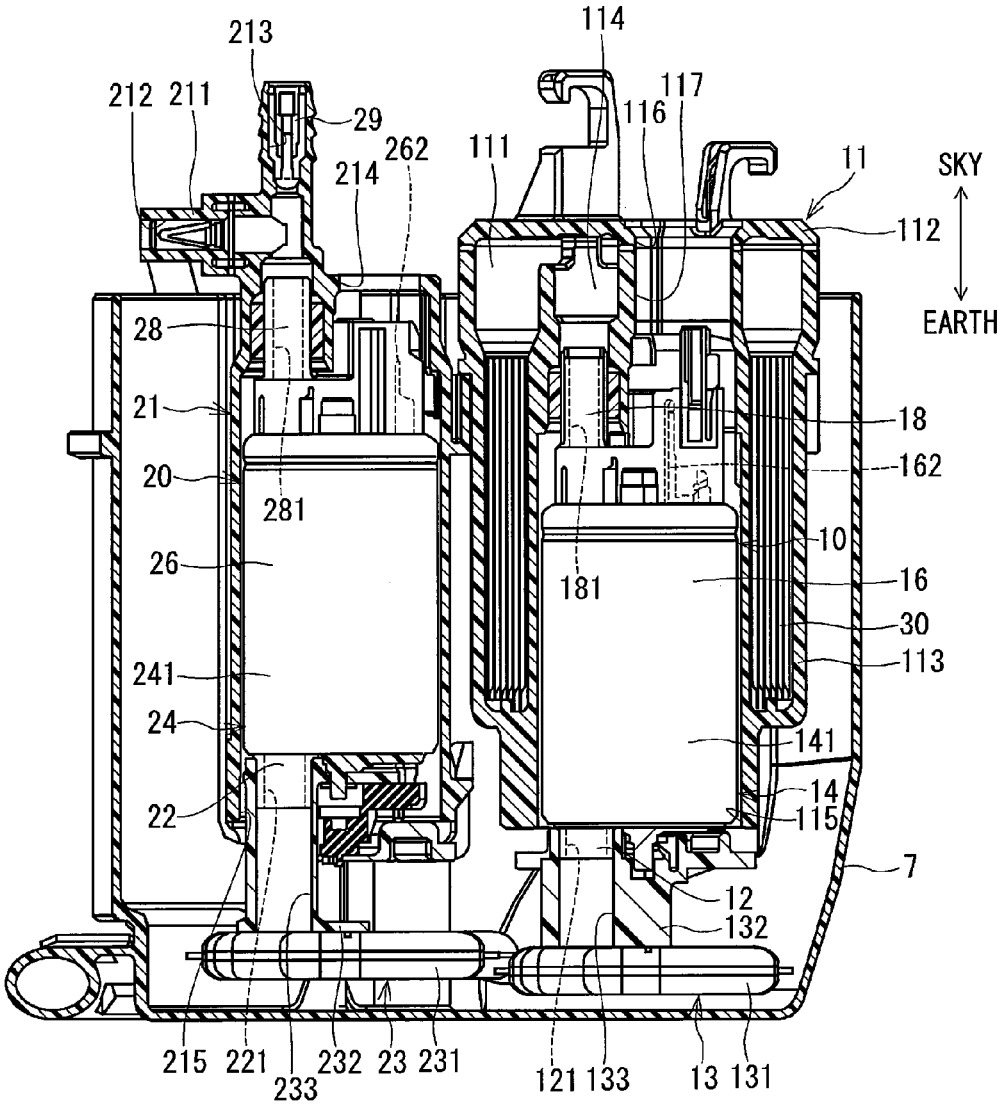
FIG. 4 is a sectional view of the first module in the fuel pump module in one embodiment of the present disclosure.

Referring to FIG. 4, the side part 113 has (i) a cylindrical space with a bottom, or a one-end-closed cylinder, with two openings, i.e., an opening 117 in communication with the through hole 116 of the bottom part 112 and an opening 115 that is formed on a filter side that is close to the suction filter 13, and (ii) a donut shape space, or a ring shape space, that is positioned on a radially-outer portion of the cylindrical space. In the one-end-closed cylinder, the DI fuel pump 10 is housed. The DI fuel pump 10 is housed in the one-end-closed cylinder through the opening 115. Further, through the opening 117, a connector that is electrically connected with the power supply terminal 162 is housed. At a position that corresponds to the discharge port 181 of the side part 113, a connection chamber 114 is formed for communication between the discharge port 181 and the fuel passage 111. The fuel discharged from the discharge port 181 flows through the connection chamber 114 and is sent into the fuel passage 111.

In the donut shape space of the side part 113, the DI filter 30 substantially in a cylindrical shape is housed. The DI filter 30 is made of a conductive resin which does not contain carbon, for example, and removes foreign substance from the fuel that is discharged from the discharge port 181. The fuel flowing through the DI filter 30 is sent into the connection part 119 that is disposed on a radially-outer portion of the pump case 11.

The connection part 119 is disposed on a radially-outer portion of the side part 113, and houses a pressure regulating valve 153. The pressure of the fuel sent to the connection part 119 is adjusted to a desired value by the pressure regulating valve 153. The pressure adjusted fuel is then sent to an outside of the first tank 2 via a supply pipe 182 (see FIG. 1) and the DI supply port 51 that is disposed on the first flange 50.

The suction filter 23 includes a saccate element 231, a connection part 232 substantially in a cylindrical shape, and the like. The suction filter 23 removes foreign substance from the fuel in the primary subtank 7 by using the element 231. The connection part 232 is disposed at a position between the element 231 and a suction part 22 of the PI fuel pump 20, and is connected to the suction part 22. A connection port 233, which is provided by the connection part 232, allows communication between an inside of the element 231 and a suction port 221 which is a part of the suction part 22 of the PI fuel pump 20.

The PI fuel pump 20 is an electromotive pump disposed in the primary subtank 7 of the first tank 2 just like the DI fuel pump 10. The PI fuel pump 20 pressurizes the fuel in the primary subtank 7 to an arbitrary pressure level between 350 to 500 kPa, for example, and sends the fuel to the second tank 3 via a transport pipe 91 leading to a transport port 52 that is disposed on the first flange 50, and, at the same time, supplies the pressurized fuel to the first jet pump 35 that is mentioned later. The PI fuel pump 20 comprises the suction part 22, a pump part 24, a motor part 26, a discharge part 28, and the like.

The suction part 22 is disposed on a filter side of the PI fuel pump 20, close to the suction filter 23, of the PI fuel pump 20, and is connected to the pump part 24 of the PI fuel pump 20. The suction part 22 has the suction port 221. The suction port 221 allows communication between an inside of the suction filter 23 and an inside of the pump part 24. The suction port 221 is disposed at an away-from-axis position, i.e., a position that is different from an axis of the PI fuel pump 20, and sends the fuel from the primary subtank 7 via the suction filter 23 to the pump part 24.

The pump part 24 comprises an impeller which is not illustrated, a pump case 241 which forms a pump room, in which the impeller is rotatably accommodated, together with other parts. The pump part 24 allows communication between the suction port 221 of the suction part 22 and a discharge port 281 of the discharge part 28.

The motor part 26 is a brushless motor which includes a stator, a rotor, a shaft, and the like, all of which are not illustrated. When an electric power is supplied to a not-illustrated winding which is wound on a cylindrical stator via a wire harness 261 (see FIG. 2) and a power supply terminal 262, a rotor provided in an inside of the stator rotates together with the shaft. A rotation torque of the shaft is transmitted to the impeller of the pump part 24. In such manner, the impeller of the pump part 24 rotates, the fuel in the pump part 24 is pressurized, and the pressurized fuel is sent to the discharge part 28.

The discharge part 28 is disposed on an opposite side of the suction part 22 relative to the pump part 24 and the motor part 26. The discharge part 28 has the discharge port 281 which allows communication between an inside of the pump part 24 and an inside of the pump case 21. The discharge part 28 is connected to a connection part 211 that is formed in an inside of the pump case 21. The fuel pressurized by the pump part 24 is sent to a connection part 212 through the discharge port 281.

The pump case 21 is a cylindrical member having a bottom, which is made of resin. On one side of the pump case 21 close to the suction filter 23, an opening 215 is formed. The PI fuel pump 20 is inserted/assembled in an inside of the pump case 21 through the opening 215. The pump case 21 is equivalent to a "first pump housing" in the claims.

The connection part 211 disposed on an opposite side of the pump case 21 relative to the suction filter 23 has a flow passage that branches into two directions. One of the two branches, i.e., a flow passage 212, communicates with an inside of the first jet pump 35 via a supply pipe 351 (see FIG. 1 and FIG. 2) having an orifice 291. The other one of the two branches, i.e., a flow passage 213 houses a non-return valve 29 that regulates a flow of the fuel in one way. The fuel flowing in the other passage 213 is sent to an outside of the first tank 2 via a transport pipe 292 (see FIG. 1 and FIG. 2) and the transport port 52 disposed on the first flange 50.

At a position on an opposite side of the pump case 21 opposite to the suction filter 23, a through hole 214 is formed, which is a different position from the connection part 211. Through the through hole 214, a connector that is electrically connected with a power supply terminal 262 of the motor part 26 is inserted/installed.

Figure 2:
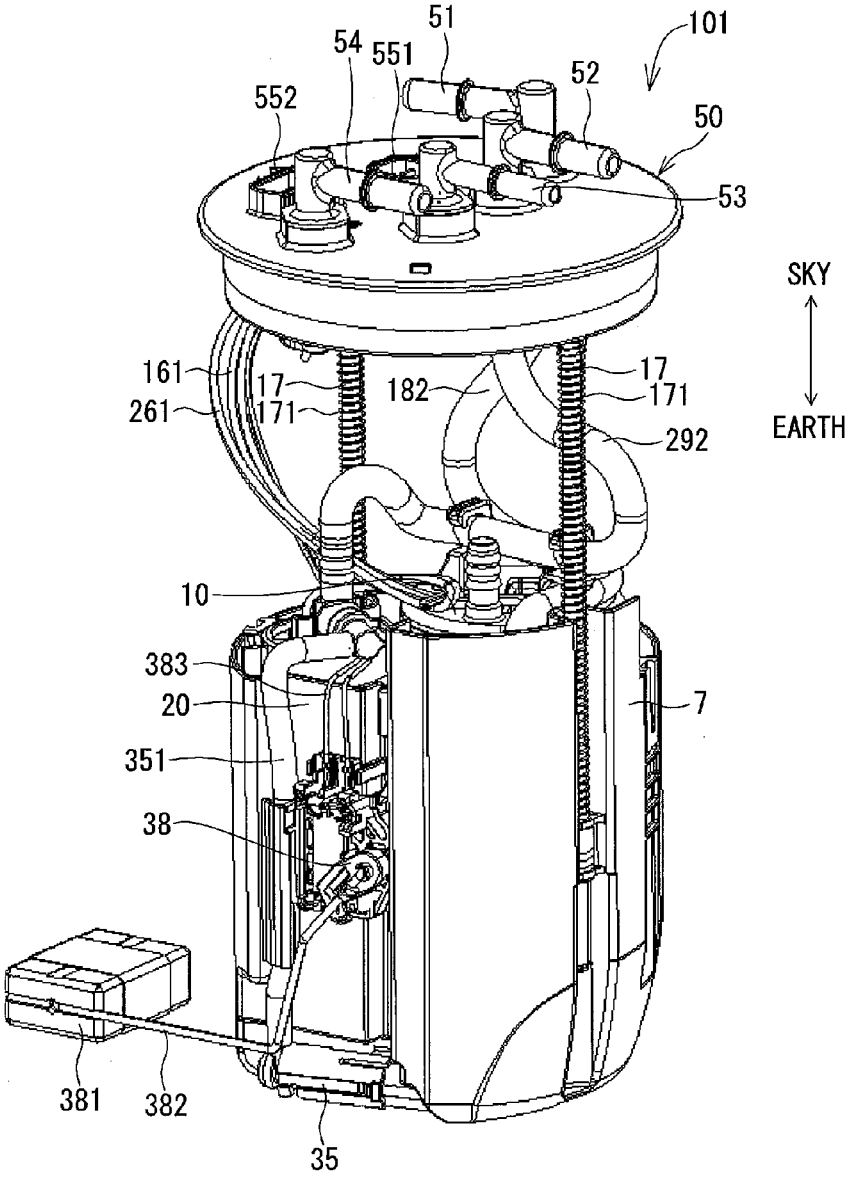
FIG. 2 is a perspective view of a first module in the fuel pump module in one embodiment of the present disclosure.

As shown in FIG. 2, the first jet pump 35 is disposed on the other end of the module 101 relative to the first flange 50, at a radially-outer portion of the primary subtank 7. The first jet pump 35 introduces the fuel from the first tank room 201 to the primary subtank 7 with a help of the pressure of the discharged fuel from the PI fuel pump 20. In FIG. 2 and FIG. 4, an upward direction with respect to the drawing is designated a "sky" side, and a downward direction with respect to the drawing is designated as an "earth" side.

Figure 3:
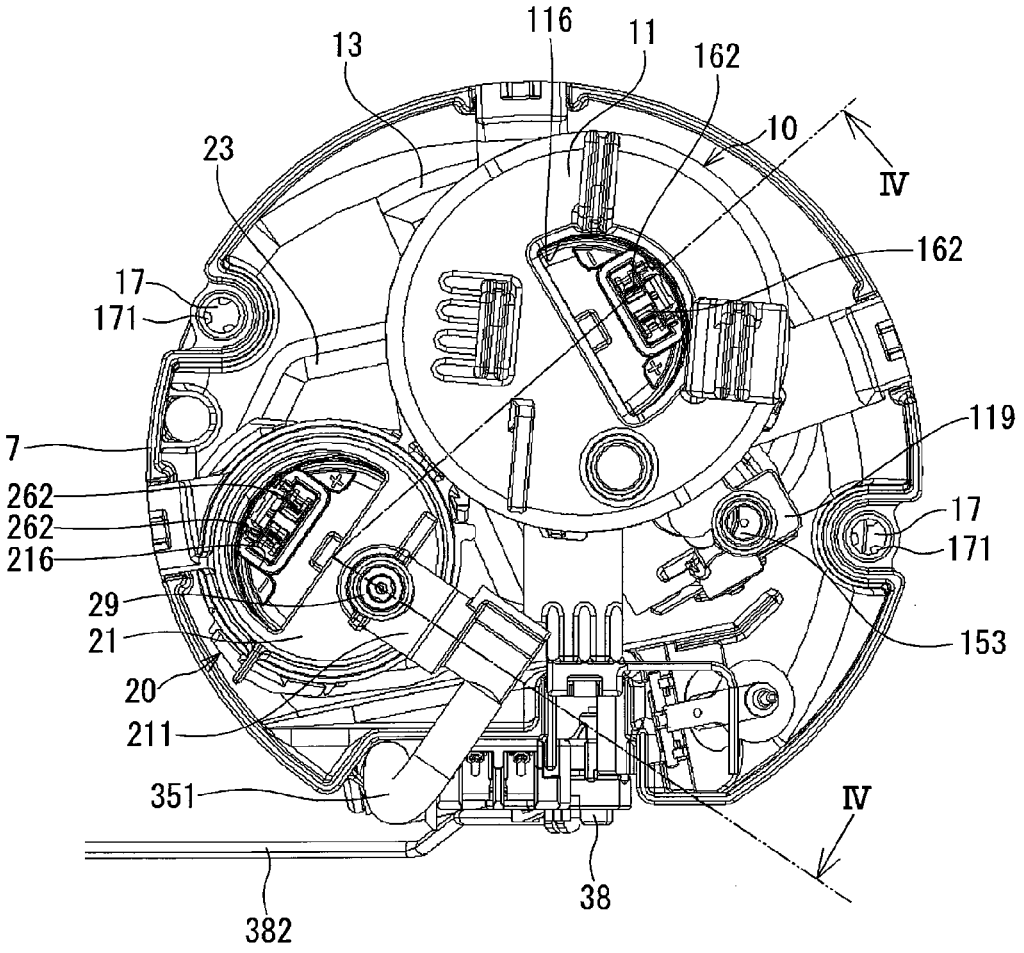
FIG. 3 is a top view of the first module in the fuel pump module in one embodiment of the present disclosure.

A sender gauge 38 is disposed at a radially-outer portion of the primary subtank 7, as shown in FIGS. 2 and 3. The sender gauge 38 is connected with a float 381 via an arm 382. When the float 381 moves according to a change of a fuel level, the arm 382 rotates, and the fuel level is detected by the sender gauge 38 based on a detection of the rotation amount of the arm 381. The sender gauge 38 outputs a fuel-level detection signal via a wire harness 383 and the first flange 50 to a non-illustrated electrical control unit (i.e., hereafter an "ECU") which is disposed externally to the module 101.

The first flange 50 is formed in a disk shape, and it is put on an opening 200 of the first tank 2, which is "one opening" and serves as a cover of the opening 200 (see FIG. 1). On the first flange 50, a transport port 53 through which the fuel flows from the second tank 3 to the primary subtank 7 and a reflux port 54 which allows a reflux of the fuel flowing from a pressure regulating valve 253 disposed in a port injection supply pipe 25 (i.e., hereafter a "Pl supply pipe 253") to be mentioned later back to the primary subtank 7 are provided, besides the DI supply port 51 and the transport port 52. Further, on the first flange 50, an external connector 551 which is electrically connected to the wire harnesses 161 and 261 and supplies an electric power to the DI fuel pump 10 and the PI fuel pump 20 and an external connector 552 which outputs, to an outside of the module 1 via the wire harness 383, a signal of the fuel level which is detected by the sender gauge 38 are disposed.

The primary subtank 7 is formed in a bottom-closed cylinder shape and is made from resin. The primary subtank 7 houses the DI fuel pump 10, the PI fuel pump 20, and the like, as mentioned above, and, on a radially-outer portion of the primary subtank 7, the first jet pump 35 and the sender gauge 38 are disposed.

As shown in FIG. 2, the first flange 50 and the primary subtank 7 are connected by two shafts 17 so that a relative position of the two (i.e., the flange 50 and the primary subtank 7) is changeable. On a radially-outer portion of the shaft 17, a spring 171 biasing the first flange 50 and the primary subtank 7 away from each other is disposed. Thereby, the primary subtank 7 is pressed against a bottom of the first tank 2.

The second module 102 is disposed in the second tank 3. The second module 102 removes foreign substance from the fuel that is sent from the first tank 2 and supplies the fuel to the engine 4, and/or transports the fuel in the second tank 3 to the first tank 2 with a help of the pressure of the fuel that is sent from the first tank 2. The second module 102 is provided with a port injection filter 40 (i.e., hereafter a "PI filter 40"), a filter case 41, a residual pressure maintenance valve 47, a second jet pump 45, a second flange 60, and the like. The PI filter 40 is equivalent to a "second filter" in the claims. The filter case 41 is equivalent to a "housing member" in the claims. The second jet pump 45 is equivalent to a "fuel transport unit". Further, in FIG. 5 and FIG. 7, an upward direction with respect to the drawing is designated as a "sky" side, and a down upward direction with respect to the drawing is designated as an "earth side".

The PI filter 40 is substantially formed in a cylinder shape, and is housed in the filter case 41 that has the same shape as the pump case 11 of the DI fuel pump 10. More practically, the PI filter 40 is housed in a donut shape space, which is in an inside of the filter case 41. The PI filter 40 is, for example, made from a conductive material which does not contain carbon or the like. The PI filter 40 removes foreign substance from the fuel that is sent from the first tank 2.

The filter case 41 is supported by an outer bracket 43 through a ring-shape inner bracket 42 that has a ring shape. A column shape space substantially at the center of the filter case 41, a ground bracket 44 is housed as shown in FIG. 7.

The filter case 41 has, disposed thereon, a transport pipe 412 and a transport port 413, which introduce the fuel from the first tank 2 via a transport port 62 on the second flange 60 into an inside of the case 41. The fuel introduced into the filter case 41 through the transport port 413 passes a fuel passage 414 and the PI filter 40 in an inside of the filter case 41. The fuel flowing through the PI filter 40 is supplied to the air-intake system 5 of the engine 4 via a supply pipe 282, a port injection supply port 61 (i.e., hereafter a "PI supply port 61") disposed on the second flange 60, and the PI supply pipe 25 connected to the PI supply port 61. Further, a part of the fuel which passes the PI filter 40 is introduced into the residual pressure maintenance valve 47 that is housed in a radially-outer portion of the filter case 41. The PI supply port 61 is equivalent to a "second supply port" in the claims.

Figure 7:
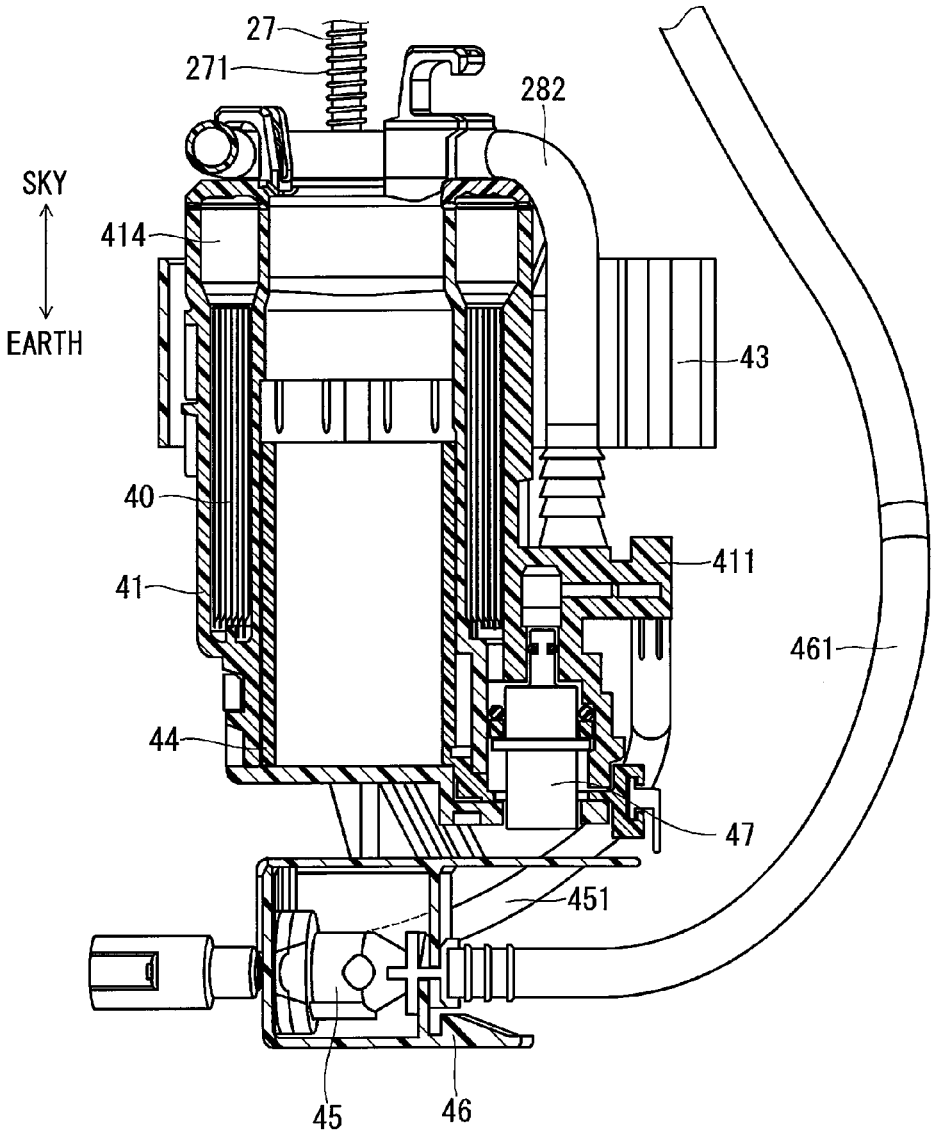
FIG. 7 is a sectional view of the second module in the fuel pump module in one embodiment of the present disclosure.

The residual pressure maintenance valve 47 is housed in a connection part 411 disposed on a radially-outer portion of the filter case 41, as shown in FIG. 7. The residual pressure maintenance valve 47 serving as a "pressure regulating valve," maintains a pressure of the fuel in an inside of the PI filter 40, which is disposed on an upstream side of the valve 47, at a certain level such as 320 kPa, for example, and prevents the fuel in the PI filter 40 to evaporate. The fuel flowing through the residual pressure maintenance valve 47 is sent to the second jet pump 45 through a supply pipe 451.

The second jet pump 45 is disposed on an opposite side of an outer bracket 43 opposite to the second flange 60, (i.e., at a lower position with respect to gravity) of the outer bracket 43 between (i) a secondary subtank 46 serving as a "supporting member" and (ii) the outer bracket 43. The second jet pump 45 comprises a jet part 452, a suction part 453, and the like.

Further, the filter case 41 houses at least one of the first pump, the second pump, the first filter, or the second filter. The secondary subtank 46 is connected to the filter case 41 at a position that is lower (i.e., a lower position with respect to gravity) than the filter case 41. The second jet pump 45 is disposed at a position between the filter case 41 and the secondary subtank 46.

The jet part 452 comprises a supply part 454, a throat part 455, and the like. The supply part 454 is substantially in a cylindrical shape. The supply part 454 is connected to a supply pipe 451, and the fuel that has passed the residual pressure maintenance valve 47 is supplied to the supply part 454. The throat part 455 is connected to the supply part 454, and is formed to have a gradually-decreasing inner diameter as the throat part 455 comes afar from the supply part 454. The throat part 455 is inserted into the suction part 453, with its opening that is opposite to the supply part 454 positioned in a suction room 456 of the suction part 453. On one side of the supply part 454 which is close to the throat part 455, a swirling flow formation member 457 is disposed.

Figure 8A:
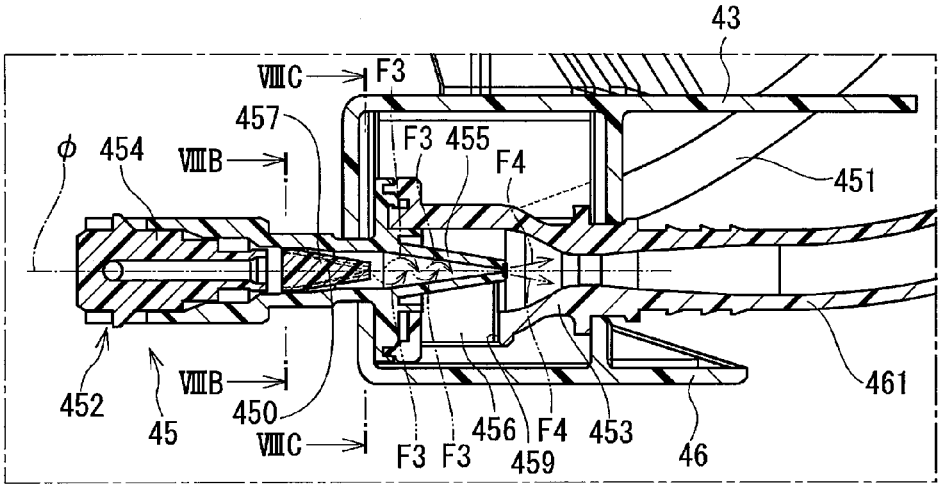
FIG. 8A is a sectional view of a second jet pump in the fuel pump module in one embodiment of the present disclosure.
Figure 8B:
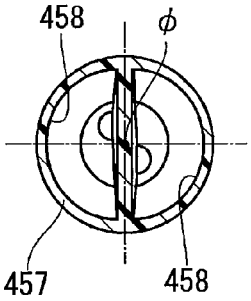
FIG. 8B is another sectional view of the second jet pump in the fuel pump module in one embodiment of the present disclosure.
Figure 8C:
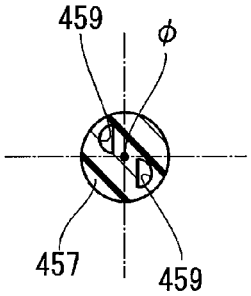
FIG. 8C is yet another sectional view of the second jet pump in the fuel pump module in one embodiment of the present disclosure.

The swirling flow formation member 457 is formed in an inner diameter decreasing shape from one side to the other, i.e., from a supply part 454 side to a throat part 455 side. In other words, the swirling flow formation member 457 has a gradually-decreasing inner diameter along the flow direction of the fuel inside of the fuel transport unit. One end of the swirling flow formation member 457 close to the supply part 454 has, as shown in FIG. 8B, two half circle openings 458. The openings 458 may be formed symmetrically with respect to a center axis ($\phi$) of the jet part 452. The other end of the swirling flow formation member 457 close to the throat part 455 also has, as shown in FIG. 8C, has two half circle openings 459 whose opening area size is smaller than the opening 458. The openings 459 are positioned point-symmetrically on the center axis $\phi$ of the jet part 452. In other words, the openings 459 may be formed symmetrically with respect to the center axis ($\phi$) of a flow of the fuel inside of the jet part 452. The fuel passing through the opening 459 flows in a direction that is non-parallel with respect to the center axis $\phi$ of the jet part 452, which is a flow direction of the fuel in the jet pump 45. The opening 458 and opening 459 are in communication with each other, and the swirling flow formation member 457 has two passages respectively having a slope 450.

The suction part 453 is formed substantially in a cylindrical shape, and provides the suction room 456 in an inside thereof into which the fuel in secondary subtank 46 is suctioned. The suction part 453 is in connection with a transport pipe 461, and the suction room 456 is, via the transport pipe 461, in communication with a transport port 63 provided on the second flange 60. The opening 459 is provided on an outer wall of the suction part 453, for the communication between the suction room 456 and an inside of the secondary subtank 46.

The second jet pump 45 is a so-called press-down type jet pump, and suctions the fuel from the second tank 3 with a help of the pressure of the fuel supplied from the residual pressure maintenance valve 47. As shown in FIG. 8A, the fuel passing through the swirling flow formation member 457 in the jet part 452 forms a swirling flow F3 that swirls substantially around the center axis ϕ (i.e., a two-dot chain line arrow of FIG. 8A). The swirling flow F3 is injected into the suction room 456 of the suction part 453 at a high speed from the throat part 455 that has a gradually-decreasing inner diameter (i.e., a two-dot chain line arrow F4 of FIG. 8A). At such time, the fuel of the suction room 456 flows into the transport pipe 461 accompanied and induced by the injected fuel from the throat part 455. The fuel flowing through the transport pipe 461 is sent to an outside of the second tank 3 through the transport port 63 on the second flange 60.

Figure 5:
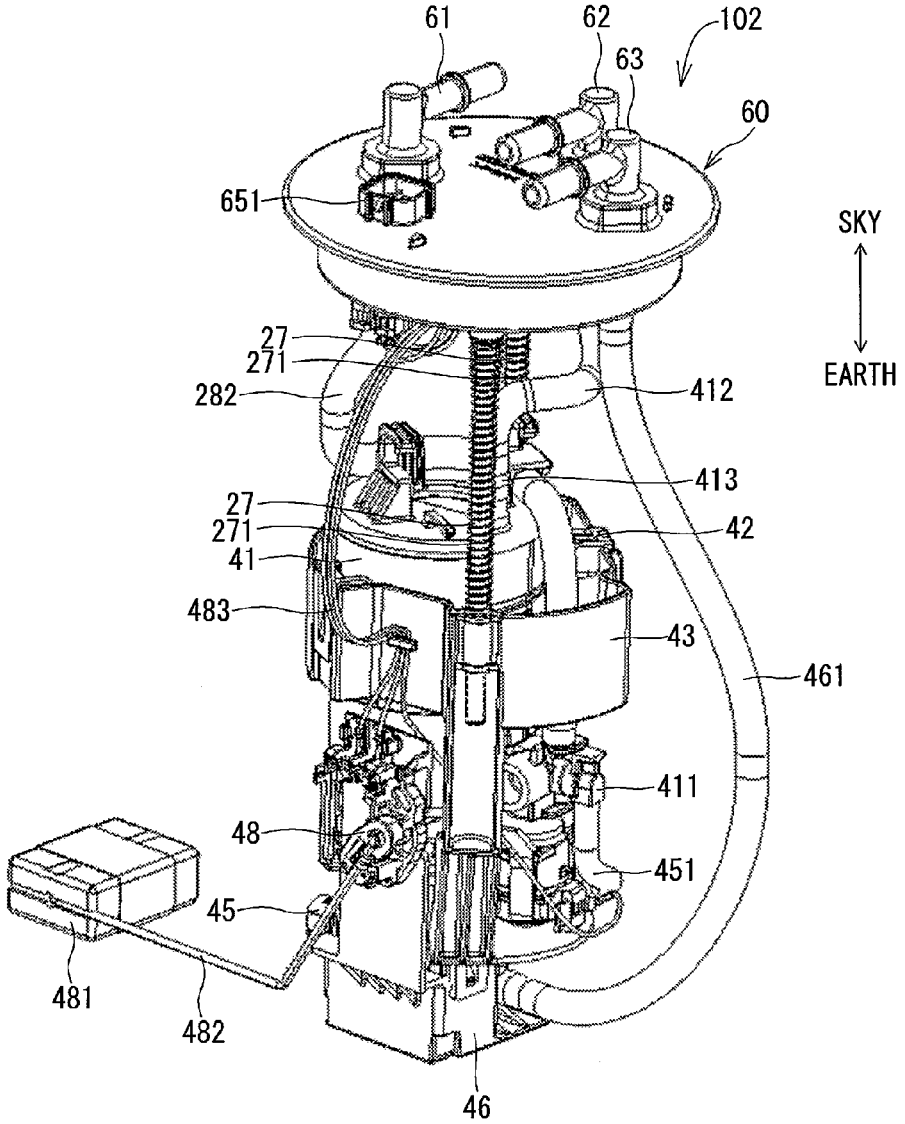
FIG. 5 is a perspective view of a second module in the fuel pump module in one embodiment of the present disclosure.
Figure 6:
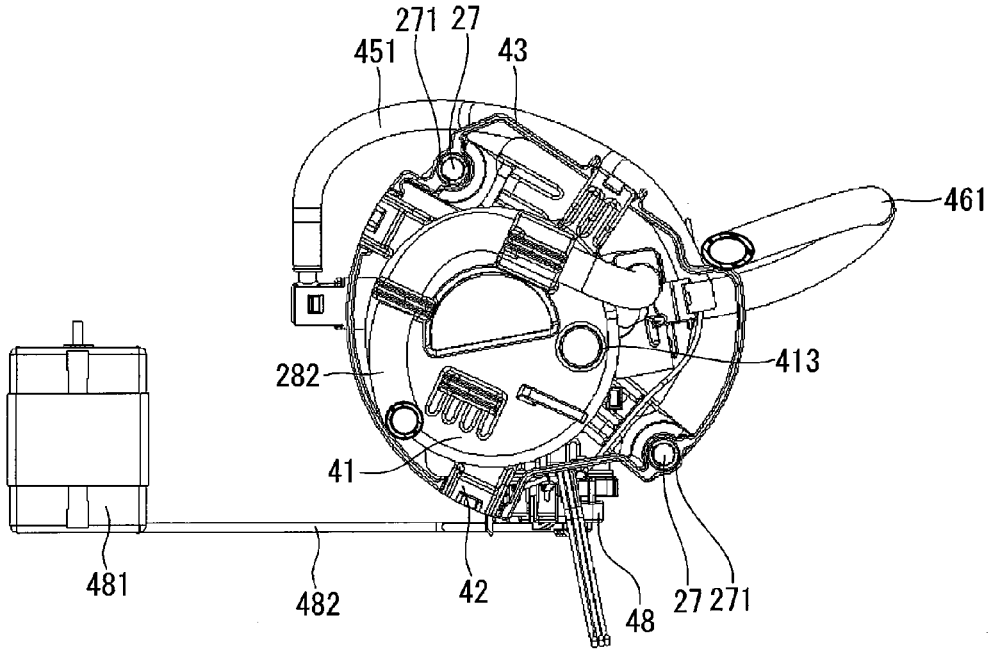
FIG. 6 is a top view of the second module in the fuel pump module in one embodiment of the present disclosure.

The sender gauge 48 is provided on a radially-outer portion of the filter case 41, as shown in FIG. 5. The sender gauge 48 is connected with a float 481 via an arm 482. When the float 481 moves according to a change of a fuel level, the arm 482 rotates, and the fuel level is detected by the sender gauge 48 by detecting a rotational amount of the arm 482. The sender gauge 48 outputs a fuel-level detection signal via the second flange 60 to an external ECU that is provided on the outside of the second module 102.

The second flange 60 is formed in a disk shape, and covers an opening 300 that serves as a "second opening". The second flange 60 has the PI supply port 61 and the transport ports 62 and 63 disposed thereon. The second flange 60 also has an external connector 651 which outputs a signal which represents the fuel level detected by the sender gauge via a wire harness 483 to an outside of the second module 102.

In the fuel pump module 1, the transport port 52 on the first flange 50 and the transport port 62 on the second flange 60 are connected with each other by the transport pipe 91 in which the fuel flows from the first tank 2 to the second tank 3. Further, the transport port 53 of the first flange 50 and the transport port 63 of the second flange 60 are connected with each other by the transport pipe 92 that serves as a "communication passage formation member" in which the fuel flows from the second tank 3 to the first tank 2. By such connections, the fuel is transported from the second tank 3 to the first tank 2 in which two fuel pumps are provided, and the fuel is securely supplied from the first tank 2 and the second tank 3 to the engine 4.

The second flange 60 and the filter case 41 are connected with two shafts 27 as shown in FIG. 5. A spring 271 is provided on a radially-outer portion of the shafts 27, with which the filter case 41 is biased away from the second flange 60. Thereby, the filter case 41 is pressed away from to the second flange 60 and is pressed against the bottom of the second tank 3.

Next, the operation of the fuel pump module 1 is described.

When an electric power is supplied to the DI fuel pump 10 and to the PI fuel pump 20 via the external connector 551 from an outside of the module 1, the DI fuel pump and the PI fuel pump are driven, and the fuel in the primary subtank 7 is suctioned via the suction filters 13 and 23 and pressurized.

Foreign substance is removed from the fuel by the DI filter 30 in the DI fuel pump 10, when the fuel discharged from the pump part 14 is filtered by the filer 30 in the pump case 11. After the removal of the foreign substance from the fuel by the DI filter 30, the pressure of the fuel is adjusted to a suitable value by the pressure regulating valve 153, and the pressure adjusted fuel is directly supplied to the combustion chamber 6 of the engine 4 through the supply pipe 182, the DI supply port 51 on the first flange 50, and the DI supply pipe 15.

On the other hand, in the PI fuel pump 20, the fuel discharged from the pump part 24 is in part transported into the second tank 3 through the transport pipe 492, the transport port 52 on the first flange 50, the transport pipe 91, the transport port 62 on the second flange 60, and the transport pipe 412, after passing through the non-return valve 49. Further, the fuel from the pump part 24 is in part supplied to the first jet pump 35 through the supply pipe 351. In the first jet pump 35, the fuel is introduced from the first tank 2 into the primary subtank 7 with a help of the pressure of the supplied fuel.

The pressurized fuel which is transported from the first tank 2 through transport pipe 91 to the second tank 3 passes through the PI filter 40 for the removal of a foreign substance. The fuel from the PI filter 40 is in part supplied to the air-intake system 5 of the engine 4 through the supply pipe 282, the PI supply port 61 on the second flange 60, and the PI supply pipe 25. At such time, the pressure of the fuel passing through the PI supply pipe 25 is adjusted by the pressure regulating valve 253 according to the pressure of an intake air introduced via the vent pipe 255 which is open to the air-intake system 5, for example. After the pressure adjustment, the surplus fuel which will no longer be supplied to the air-intake system 5 is returned to the first tank 2 via the return pipe 254 and the reflux opening 54 on the first flange 50.

Further, a part of the fuel passing through the PI filter 40 is supplied to the second jet pump 45 through the residual pressure maintenance valve 47 and the supply pipe 451. The second jet pump 45 sends the fuel from the second tank 3 to the primary subtank 7 via the transport pipe 461, the transport port 63 on the second flange 60, the transport pipe 92, and the transport port 53 on the first flange 50 with a help of the pressure of the supplied fuel. Thereby, the fuel of the second tank room 301 that serves as a "one fuel tank room" is pressurized by the DI fuel pump and the PI fuel pump in the first tank 2, and is supplied to the engine 4.

In the fuel pump module 1 in one embodiment, the second jet pump 45 that transports the fuel in the second tank room 301 from the second tank 3 to the first tank 2 forms a swirling flow in an inside thereof. In the following, the effect of the swirling flow formed in the jet pump is described based on FIGS. 8A/B/C and 9A/B.

Figure 9A:
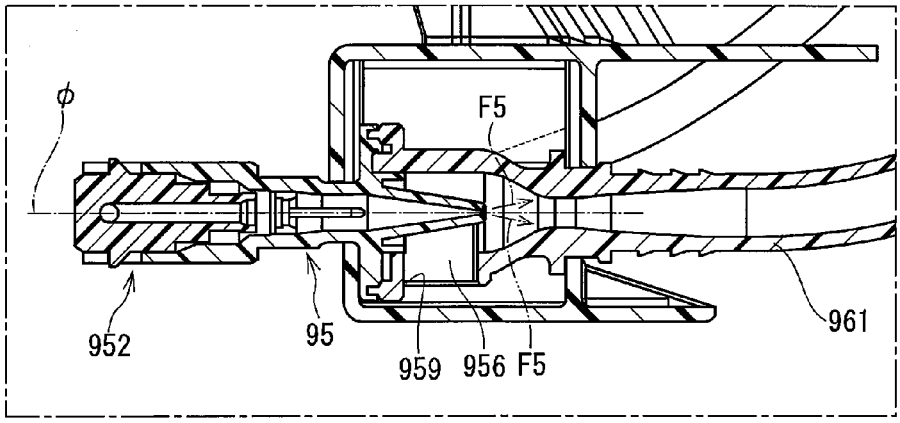
FIG. 9A is a sectional view of a jet pump in a comparative example.
Figure 9B:
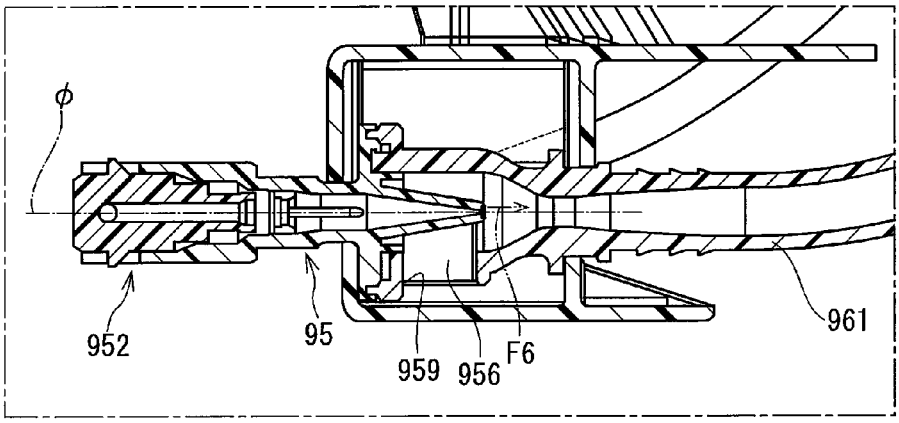
FIG. 9B is another sectional view of the jet pump in the comparative example.

The sectional views of the jet pump in FIGS. 9A/B are provided as a comparative example, in which no swirling flow formation member is provided. When an inside of the transport pipe 961 connected to a downstream side of a jet pump 95 and an inside of the suction room 956 are filled with fuel as shown in FIG. 9A, the fuel injected from a jet part 952 of the jet pump 95 diffuses due to the resistance of the fuel in the suction room 956, which is shown by two double-dotted chain line arrows F5. Thereby, the fuel injected from the jet part 952 is transported into the transport pipe 961 while inducing the fuel in the suction room 956 to be transported at the same time. However, when, for example, the fuel in the second tank room 301 decreases to a low level and temperature of the second tank room 301 rises, the fuel in an inside of the transport pipe 961 and in the suction room 956 is thinned and evaporates, thereby not causing the resistance to the fuel injected from the jet part 952. In such case, the fuel injected from the jet part 952 flows in a linear shape as shown by a two-dot chain line arrow F6 of FIG. 9B without diffusion/spreading, thereby returning back to the secondary subtank 96 through the opening 959 from the suction room 956, which may make it impossible for the jet pump 95 to transport the fuel to the first tank that is disposed separately from the second tank.

The fuel pump module 1 in one embodiment forms, as shown in FIG. 8A, a swirling flow of the fuel by the swirling flow formation member 457 in the jet part 452 (i.e., a two-point chain line arrow F3 in FIG. 8A), causing the fuel injected from the throat part 455 to be diffused in the suction room 456. Thereby, the fuel is transported to the first tank 2 via the transport pipe 461, without being influenced by the state of the fuel in the suction room 456 or the transport pipe 461. Therefore, in the fuel pump module 1, the two fuel pumps securely discharge the fuel from the fuel tank 8 to the engine 4.

Further, the second jet pump 45 is disposed at a position in between the secondary subtank 46 and the outer bracket 43. Thereby, when the outer bracket 43 is pressed against the bottom of the second tank 3 with the spring 271, the secondary subtank 46 abuts on the bottom of the second tank 3, and the biasing force of the spring 271 is not directly applied to the second jet pump 45. Therefore, breakage of the second jet pump 45 is prevented and the fuel in the second tank room 301 is securely discharged to the engine 4.

The swirling flow formation member 457 of the second jet pump 45 has two openings 459 formed on the end close to the throat part 455. The plurality of flows of the fuel passing through the opening 459 flow in the non-parallel direction with respect to the center axis (ϕ) of the jet part 452, and the swirling flow is caused as a combination of the plurality of flows. In the jet pump of the fuel pump module in the patent document 1 mentioned above, the swirling flow is formed by the fuel that flows along a non-aligned direction relative to the center axis of a swirl room, thereby the pressure of the fuel is mainly applied to a tangential direction of the swirling flow with little or no effect in the axial direction of the swirl. Therefore, a jet nozzle formed in parallel with the axial direction of a swirl room cannot inject the fuel at high speed. Further, when plurality of fuel tank rooms are provided at separate positions due to the restriction of the fuel tank layout in the vehicle, the fuel pump module in the patent document 1 may be not capable of stably transporting the fuel from one fuel tank room to the other because of the above-described jet nozzle that cannot inject the fuel at high speed. On the other hand, the fuel pump module 1 in one embodiment of the present disclosure applies the pressure of the fuel that is discharged from the PI fuel pump 20 in the axial direction of the swirling flow, thereby effectively utilizing the pressure of the discharged fuel from the PI fuel pump 20. In such manner, the pressure of the fuel injected from the second jet pump 45 becomes relatively high, thereby enabling a secure transportation of the fuel from the distantly-positioned second tank room 301 to the first tank room 201.

Further, the swirling flow formation member 457 of the second jet pump 45 has its inner diameter gradually decreasing from a supply part 454 side toward a throat part 455 side. Thereby, the speed of the fuel flowing through the throat part 455 is relatively high, which effectively causes the suction of the fuel at the suction part 453.

Other Embodiments (a) According to the above-mentioned embodiment, the fuel tank is described as a split-type fuel tank that has two tanks, i.e., the first tank and the second tank, in communication with each other. However, the fuel tank may have other configuration, such as a saddle-type fuel tank in which the bottom part of the fuel tank room where the fuel is stored is split into two. The number of the fuel tank rooms is not limited to two, but may be three or more.

(b) According to the above-mentioned embodiment, the fuel pump module is described as having two fuel pumps. However, the number of the fuel pumps in the fuel pump module is not limited to two. The number of the fuel pumps may be three or more, may be only one. The same applies to the filter, the supply port, and the flange.

(c) According to the above-mentioned embodiment, the swirling flow formation member is described that it has two half circle openings at the end close to the supply part, has two half circle openings at the end close to the suction part, and has two passages which allow communication between the supply part side openings and the suction part side openings. However, the shape of the swirling flow formation member is not limited to such shape. That is, as long as it is capable of forming the swirling flow, the member may have any shape.

(d) According to the above-mentioned embodiment, the second jet pump sends the fuel from the second tank room to the first tank room with the help of the pressure of the fuel that is discharged from the PI fuel pump. However, the second jet pump serving as a "fuel transport unit" may be driven in other manners.

(e) According to the above-mentioned embodiment, the second jet pump is disposed at a "bound" position in between the outer bracket and the secondary subtank. However, the second jet pump serving as a "fuel transport unit" may be disposed in other manners.

As mentioned above, the fuel pump module may be variably implemented as long as the gist of the fuel pump module pertains to the inventive feature of the present disclosure.

What is claimed is:

1. A fuel pump module which supplies fuel to an internal-combustion engine from a fuel tank having a plurality of fuel tank rooms and discharges the fuel from the fuel tank to a combustion chamber of the internal-combustion engine, the fuel pump module comprising:

a first pump discharging the fuel from the fuel tank to the combustion chamber of the internal-combustion engine;

a first filter removing foreign substance from the fuel that is discharged from the first pump;

a first supply port disposed at a position between the first filter and the combustion chamber into which the fuel is discharged from the first pump, the first supply port allowing the fuel filtered by the first filter to flow therethrough;

a second pump discharging the fuel from the fuel tank to an air-intake system of the internal-combustion engine;

a second supply port disposed at a position between a second filter and the air-intake system, the second supply port allowing the fuel filtered by the second filter to flow therethrough;

a jet pump transporting the fuel to a first fuel tank room that houses the first pump and the second pump from a second fuel tank room;

a communication passage providing fluid communication between the first fuel tank room and the second fuel tank room through which the fuel transported by the jet pump flows, wherein the jet pump causes a swirling flow of the fuel when the first pump or the second pump discharges the fuel;

a filter case housing at least the second filter; and a subtank connected to the filter case at a position that is lower than the filter case, wherein the jet pump is disposed at a position between the filter case and the subtank.

2. The fuel pump module of claim 1, further comprising:

a plurality of openings provided on the jet pump, the plurality of openings causing the fuel to flow in a non-parallel direction relative to a flow direction of the fuel inside of the jet pump, wherein the fuel passing through the plurality of openings has a swirling flow.

3. The fuel pump module of claim 2, wherein the plurality of openings are formed symmetrically with respect to a center axis of a flow of the fuel inside of the jet pump.

4. The fuel pump module of claim 2, further comprising:

a swirling flow formation member provided on the jet pump and having an opening with a gradually-decreasing inner diameter along the flow direction of the fuel inside of the fuel transport unit.

* * * * *